US010143619B2

(12) United States Patent
Chapman et al.

(10) Patent No.: US 10,143,619 B2
(45) Date of Patent: Dec. 4, 2018

(54) CPR CHEST COMPRESSION MACHINE PERFORMING PROLONGED CHEST COMPRESSION

(71) Applicant: Physio-Control, Inc., Redmond, WA (US)

(72) Inventors: Fred W. Chapman, Newcastle, WA (US); Bjarne Madsen Hardig, Lund (SE)

(73) Assignee: Physio-Control, Inc., Redmond, WA (US)

( * ) Notice: Subject to any disclaimer, the term of this patent is extended or adjusted under 35 U.S.C. 154(b) by 1216 days.

(21) Appl. No.: 14/271,660

(22) Filed: May 7, 2014

(65) Prior Publication Data

US 2014/0336546 A1 Nov. 13, 2014

Related U.S. Application Data

(60) Provisional application No. 61/822,234, filed on May 10, 2013.

(51) Int. Cl.
*A61H 31/00* (2006.01)

(52) U.S. Cl.
CPC ..... *A61H 31/00* (2013.01); *A61H 31/005* (2013.01); *A61H 31/006* (2013.01);
(Continued)

(58) Field of Classification Search
CPC .... A61H 31/00; A61H 31/004; A61H 31/005; A61H 31/006; A61H 31/008; A61H 2201/1246
See application file for complete search history.

(56) References Cited

U.S. PATENT DOCUMENTS 3,985,126 A * 10/1976 Barkalow ..... A61H 31/008 601/106
4,060,079 A * 11/1977 Reinhold, Jr. ..... A61G 1/013 128/204.18

(Continued)

FOREIGN PATENT DOCUMENTS

WO 2006039166 A2 4/2006
WO 2014051934 A1 4/2014

OTHER PUBLICATIONS

Eric Qvistad, Clinical pilot study of different hand positions during manual chest compressions monitored with capnography, Resuscitation, 2013, 1203-1207, 84 (2013), Elsevier.

(Continued)

*Primary Examiner* — Michael Tsai
*Assistant Examiner* — Christopher Miller
(74) *Attorney, Agent, or Firm* — Miller Nash Graham & Dunn LLP

(57) ABSTRACT

Various types of chest compressions may be performed on a patient during a single resuscitation event. In embodiments one or more compression time parameters may be changed during the event, potentially optimizing blood flow for one side of the patient's heart, then the other. In some embodiments the event includes one or more prolonged compressions interposed between other compressions, potentially enabling the blood to reach to more remote locations than otherwise. In embodiments, a CPR chest compression machine includes a compression mechanism configured to perform successive compressions to the patient's chest, and a driver configured to drive the compression mechanism accordingly. In embodiments, a CPR metronome issues prompts for compressions accordingly.

9 Claims, 7 Drawing Sheets

*PROLONGED COMPRESSION BETWEEN SERIES OF COMPRESSIONS*

(52) U.S. Cl.
CPC ..... *A61H 31/007* (2013.01); *A61H 2230/045* (2013.01); *A61H 2230/065* (2013.01); *A61H 2230/208* (2013.01); *A61H 2230/305* (2013.01); *A61H 2230/425* (2013.01)

(56) References Cited

U.S. PATENT DOCUMENTS

| | | | | |
|---|---|---|---|---|
| 4,424,806 | A * | 1/1984 | Newman | A61H 9/0078 128/205.25 |
| 4,928,674 | A * | 5/1990 | Halperin | A61H 9/0078 600/495 |
| 5,261,394 | A | 11/1993 | Mulligan et al. | |
| 6,447,465 | B1 * | 9/2002 | Sherman | A61H 31/00 601/41 |
| 7,569,021 | B2 * | 8/2009 | Sebelius | A61H 31/008 601/108 |
| 9,724,266 | B2 * | 8/2017 | Voss | A61H 31/004 |
| 2002/0177793 | A1 * | 11/2002 | Sherman | A61H 23/0245 601/2 |
| 2004/0082888 | A1 * | 4/2004 | Palazzolo | A61B 5/04012 601/41 |
| 2004/0162587 | A1 * | 8/2004 | Hampton | A61H 31/005 607/5 |
| 2006/0094991 | A1 * | 5/2006 | Walker | A61H 31/004 601/41 |
| 2007/0093731 | A1 | 4/2007 | Warwick et al. | |
| 2007/0270724 | A1 * | 11/2007 | Havardsholm | A61H 31/004 601/41 |
| 2007/0276298 | A1 * | 11/2007 | Sebelius | A61H 31/006 601/41 |
| 2010/0185127 | A1 * | 7/2010 | Nilsson | A61H 31/004 601/41 |
| 2010/0198118 | A1 * | 8/2010 | Itnati | A61H 31/004 601/41 |
| 2011/0201979 | A1 * | 8/2011 | Voss | A61H 31/004 601/41 |
| 2012/0016279 | A1 | 1/2012 | Banville et al. | |
| 2012/0016280 | A1 * | 1/2012 | Aliverti | A61H 11/00 601/41 |
| 2012/0203147 | A1 | 8/2012 | Lurie et al. | |
| 2012/0330199 | A1 | 12/2012 | Lurie et al. | |
| 2012/0330200 | A1 * | 12/2012 | Voss | A61H 31/004 601/41 |
| 2013/0218056 | A1 | 8/2013 | Aelen et al. | |
| 2013/0338550 | A1 * | 12/2013 | Faller | A61H 31/006 601/41 |
| 2014/0066824 | A1 * | 3/2014 | Johnson | A61H 31/00 601/43 |
| 2014/0088467 | A1 | 3/2014 | Parascandola et al. | |

OTHER PUBLICATIONS

PCT International Application No. PCT/US 14/37419, International Search Report & Written Opinion, dated Nov 20, 2014.
PCT Correspondence: Invitation to Pay Additional Fees in International Application No. PCT/US 14/37419, dated Sep. 18, 2014.

* cited by examiner

*COMPONENTS OF CPR*
*CHEST COMPRESSION MACHINE*

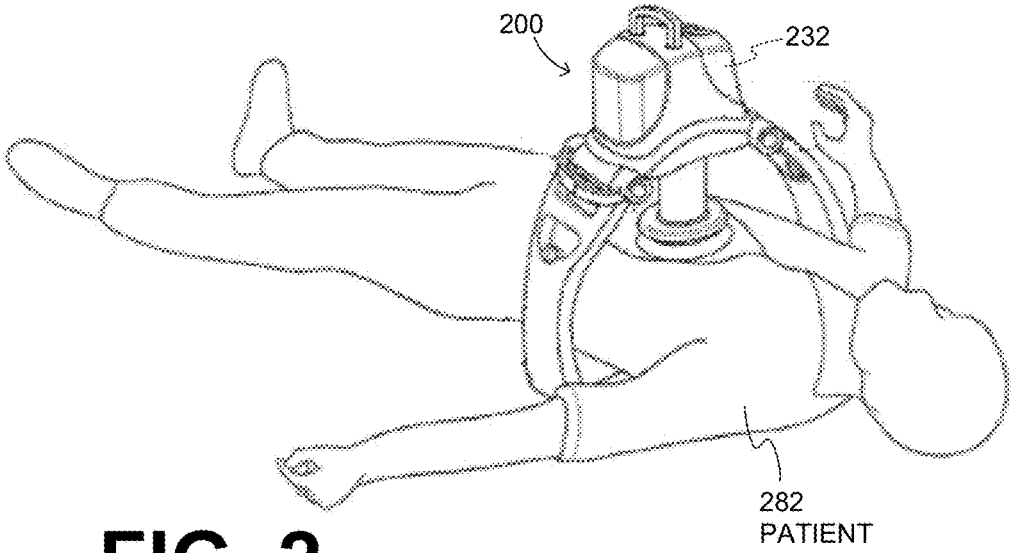
FIG. 2
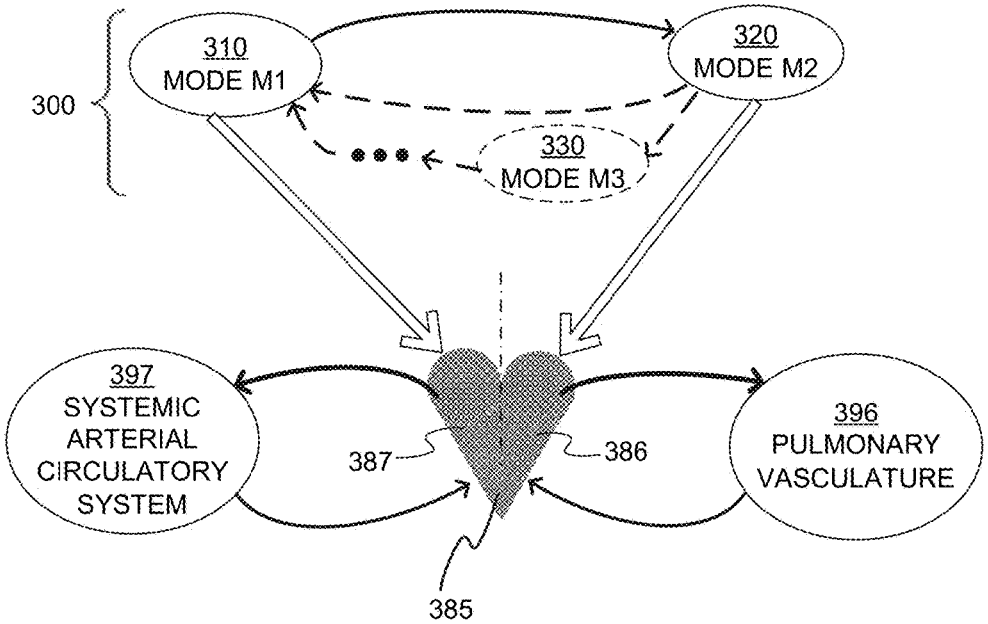
FIG. 3 CHANGING MODES

CHANGING TIME PARAMETER VALUES

SERIES OF COMPRESSIONS WITH VARYING FREQUENCIES

SERIES OF COMPRESSIONS WITH VARYING DUTY RATIOS

DUTY RATIO CONTRAST

*METHODS*

*PROLONGED COMPRESSION BETWEEN SERIES OF COMPRESSIONS*

*PROLONGED COMPRESSION BETWEEN SERIES OF COMPRESSIONS*

*METHODS*

*CPR METRONOME*

CPR CHEST COMPRESSION MACHINE PERFORMING PROLONGED CHEST COMPRESSION

CROSS REFERENCE TO RELATED PATENT APPLICATIONS

This patent application claims priority from U.S. Provisional Patent Application Ser. No. 61/822,234, filed on May 10, 2013, titled: "CPR CHEST COMPRESSIONS ALTERNATING BETWEEN TWO TYPES", the disclosure of which is hereby incorporated by reference for all purposes.

BACKGROUND

In certain types of medical emergencies a patient's heart stops working. This stops the blood flow, without which the patient may die. Cardio Pulmonary Resuscitation (CPR) can forestall the risk of death. CPR includes performing repeated chest compressions to the chest of the patient so as to cause their blood to circulate some. CPR also includes delivering rescue breaths to the patient. CPR is intended to merely maintain the patient until a more definite therapy is made available, such as defibrillation. Defibrillation is an electrical shock deliberately delivered to a person in the hope of correcting their heart rhythm.

The repeated chest compressions of CPR are actually compressions alternating with releases. They cause the blood to circulate some, which can prevent damage to organs like the brain. For making this blood circulation effective, guidelines by medical experts such as the American Heart Association dictate suggested parameters for chest compressions, such as the frequency, the depth reached, fully releasing after a compression, and so on. The releases are also called decompressions.

Traditionally, CPR has been performed manually. A number of people have been trained in CPR, including some who are not in the medical professions just in case. However, manual CPR might be ineffective, and being ineffective it may lead to irreversible damage to the patient's vital organs, such as the brain and the heart. The rescuer at the moment might not be able to recall their training, especially under the stress of the moment. And even the best trained rescuer can become quickly fatigued from performing chest compressions, at which point their performance might be degraded. Indeed, chest compressions that are not frequent enough, not deep enough, or not followed by a full decompression may fail to maintain blood circulation.

The risk of ineffective chest compressions has been addressed with CPR chest compression machines. Such machines have been known by a number of names, for example CPR chest compression machines, mechanical CPR devices, cardiac compressors and so on.

CPR chest compression machines repeatedly compress and release the chest of the patient. Such machines can be programmed so that they will automatically compress and release at the recommended rate or frequency, and can reach a specific depth within the recommended range. Some of these machines can even exert force upwards during decompressions.

At present, most CPR chest compression machines repeat the same pattern of compressions over and over, maintaining a constant rate of compressions and a constant compression wave shape. This precise consistency is non-physiologic and may miss an opportunity to better move blood through each part of the patient's circulatory systems.

BRIEF SUMMARY

The present description gives instances of time-varying chest compressions, the performing of which may help overcome problems and limitations of the prior art. Various types of chest compressions may be performed on a patient during a single resuscitation event. In embodiments one or more compression time parameters may be changed during the event. In some embodiments the event includes one or more prolonged compressions interposed between other compressions.

In some embodiments a CPR chest compression machine includes a compression mechanism configured to perform successive compressions to the patient's chest, and a driver configured to drive the compression mechanism accordingly. In some embodiments a CPR metronomes instructs to perform such compressions accordingly.

An advantage over the prior art can be improved blood flow and thus improved CPR patient outcomes. For example, blood flow may be optimized for one side of the patient's heart, then the other. For another example, one or more prolonged compressions may permit blood may be able to reach to more remote locations than otherwise.

These and other features and advantages of this description will become more readily apparent from the Detailed Description, which proceeds with reference to the associated drawings in which:

BRIEF DESCRIPTION OF THE DRAWINGS

FIG. 2 is a diagram of a sample CPR chest compression machine made according to embodiments, which is being used on a patient.

FIG. 3 is a diagram of a state machine for a CPR chest compression machine changing modes according to embodiments, and further illustrating embodiments where some of the individual modes can be adjusted for optimizing blood flow in different parts of the patient's circulatory system.

DETAILED DESCRIPTION

As has been mentioned, the present description is about CPR chest compression machines, software and methods. Embodiments are now described in more detail.

Figure 1:
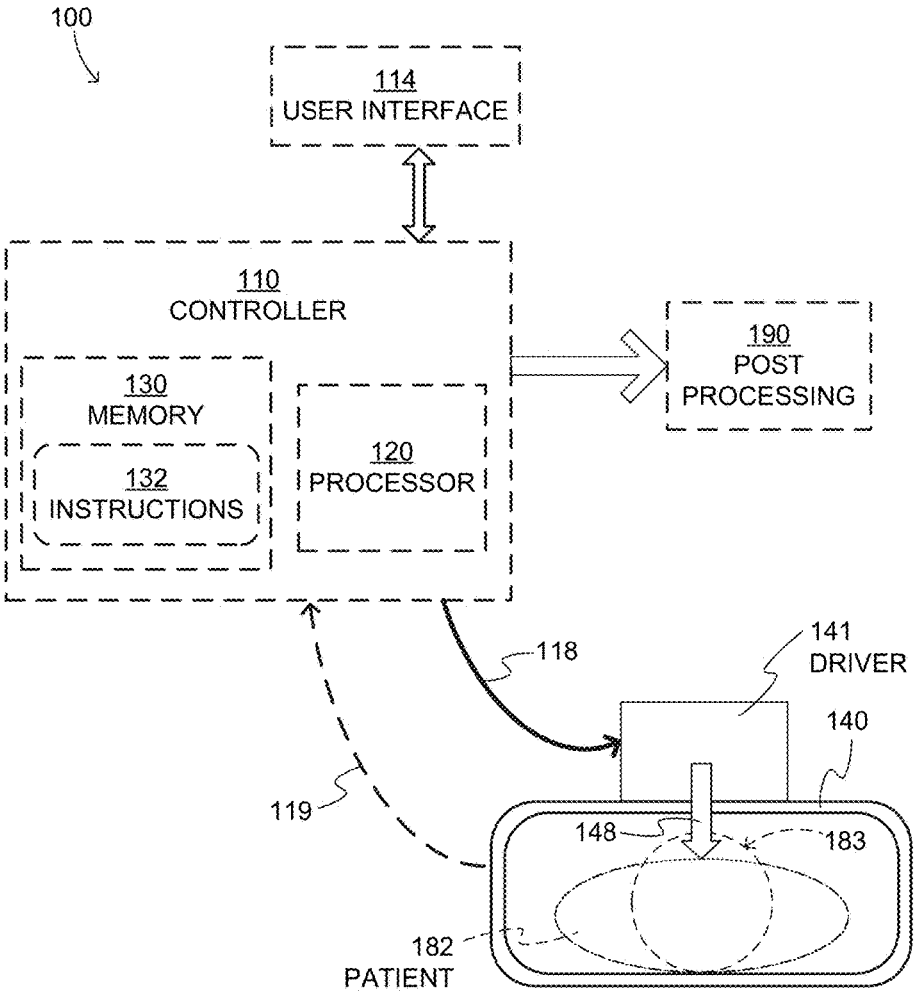
FIG. 1 is a diagram of components of an abstracted CPR chest compression machine according to embodiments.

FIG. 1 is a diagram of components 100 of an abstracted CPR chest compression machine according to embodiments. Components 100 include an abstracted retention structure 140 of a CPR chest compression machine. A patient 182 is placed within retention structure 140. Retention structure 140 retains the patient's body, and may be implemented in any number of ways. Good embodiments are disclosed in U.S. Pat. No. 7,569,021 to Jolife AB which is incorporated by reference, and are being sold by Physio-Control, Inc. under the trademark LUCAS®. In other embodiments retention structure 140 includes a belt that can be placed around the patient's chest. While retention structure 140 typically reaches the chest and the back of patient 182, it does not reach the head 183.

Components 100 also include a compression mechanism 148 configured to perform successive compressions to a chest of the patient, and a driver 141 configured to drive compression mechanism 148 so as to cause compression mechanism 148 to perform successive compressions to the patient's chest. Compression mechanism 148 and driver 141 may be implemented in combination with retention structure 140 in any number of ways. In the above mentioned example of U.S. Pat. No. 7,569,021 compression mechanism 148 includes a piston, and driver 141 includes a rack-and-pinion mechanism. In embodiments where retention structure 140 includes a belt, compression mechanism 148 may include a spool for collecting and releasing the belt so as to squeeze and release the patient's chest, and driver 141 can include a motor for driving the spool.

Driver 141 may be controlled by a controller 110 according to embodiments. Controller 110 may be coupled with a User Interface 114, for receiving user instructions, and for outputting data.

Controller 110 may include a processor 120. Processor 120 can be implemented in any number of ways, such as with a microprocessor, Application Specific Integration Circuits, programmable logic circuits, general processors, etc. While a specific use is described for processor 120, it will be understood that processor 120 can either be standalone for this specific use, or also perform other acts.

In some embodiments controller 110 additionally includes a memory 130 coupled with processor 120. Memory 130 can be implemented by one or more memory chips. Memory 130 can be a non-transitory storage medium that stores instructions 132 in the form of programs. Instructions 132 can be configured to be read by processor 120, and executed upon reading. Executing is performed by physical manipulations of physical quantities, and may result in functions, processes, actions and/or methods to be performed, and/or processor 120 to cause other devices or components to perform such functions, processes, actions and/or methods. Often, for the sake of convenience only, it is preferred to implement and describe a program as various interconnected distinct software modules or features, individually and collectively also known as software. This is not necessary, however, and there may be cases where modules are equivalently aggregated into a single program, even with unclear boundaries. In some instances, software is combined with hardware in a mix called firmware. While one or more specific uses are described for memory 130, it will be understood that memory 130 can further hold additional data, such as event data, patient data, and so on.

Controller 110 can be configured to control driver 141 according to embodiments. Controlling is indicated by arrow 118, and can be implemented by wired or wireless signals and so on. Accordingly, compressions can be performed on the chest of patient 182 as controlled by controller 110. In embodiments, the compressions are performed automatically in one or more series, and perhaps with pauses between them as described below, as controlled by controller 110. A single resuscitation event can be a single series for the same patient, or a number of series thus performed sequentially.

Controller 110 may be implemented together with retention structure 140, in a single CPR chest compression machine. In such embodiments, arrow 118 is internal to such a CPR chest compression machine. Alternately, controller 110 may be hosted by a different machine, which communicates with the CPR chest compression machine that uses retention structure 140. Such communication can be wired or wireless. The different machine can be any kind of device, such as a medical device. One such example is described in U.S. Pat. No. 7,308,304, titled "COOPERATING DEFIBRILLATORS AND EXTERNAL CHEST COMPRESSION MACHINES", only the description of which is incorporated by reference. Similarly, User Interface 114 may be implemented on the CPR chest compression machine, or on a host device.

FIG. 2 is a diagram of a sample CPR chest compression machine 200 made according to embodiments, which is being used on a patient 282. Machine 200 appears similar to the physical structure in the above mentioned example of U.S. Pat. No. 7,569,021. In addition, it has stored instructions 232 that can be similar to what is described for instructions 132.

FIG. 3 is a diagram of a state machine 300 for a CPR chest compression machine according to embodiments. While state machine 300 is described for a CPR chest compression machine, a similar state machine can also be implemented for a metronome as will be seen below.

State machine 300 is a representation of different modes in which a CPR chest machine can perform chest compressions. State machine 300 includes a state 310 during which chest compressions are performed according to a mode M1, a state 320 during which chest compressions are performed according to a mode M2, optionally a state 330 during which chest compressions are performed according to a mode M3, and so on. Modes M1, M2, M3 can be different in that one or more of the chest compressions performed during these modes can have a chest compression time parameter of a different value. As will be seen in more detail below, examples of the chest compression time parameter include the frequency or rate, the duty ratio, the time waveform of individual compressions and/or decompressions, and so on. The waveform of compression can be characterized as plunger depth versus time, or compressive force versus time.

So, according to state machine 300, operations of a CPR chest compression machine according to embodiments can include a first series of compressions according to mode M1, then a second series of compressions according to mode M2, then a third series of compressions according to mode M3 and so on. In some embodiments where there are only two states 310, 320, execution may alternate between them. When there are three or more states, execution may or may not return to state 310. When execution alternates or transitions between two modes, it can do so with or without a pause.

In many embodiments, one or more of the modes can be adjusted for optimizing blood flow into one or more of the different parts of the patient's circulatory system. More particularly, the patient's circulatory system has two main parts, namely the pulmonary vasculature 396 and the systemic arterial circulatory system 397. The heart 385 of a patient is shown with a dot-dash line dividing it into the right side 386 ("right heart 386") and the left side 387 ("left heart 387"). Right heart 386 pumps blood into pulmonary vasculature 396, where it becomes oxygenated by the lungs while carbon dioxide is removed. The oxygenated blood is then received back in heart 385. Left heart 387 then pumps the oxygenated blood into systemic arterial circulatory system 397 via the arteries. The blood is then received back in the heart via the veins. The two parts of the patient's circulatory system are mechanically different, and therefore have different hemodynamics for the purpose of pumping. For example, pulmonary vasculature 396 is more distensible than systemic arterial circulatory system 397. Moreover, the operations of each part of the patient's circulatory system are different.

In these embodiments, as further indicated by large arrows in FIG. 3, mode M1 of chest compressions may be optimized to assist the pumping operation of left heart 387, while mode M2 may be optimized to assist the pumping operation of right heart 386. In some of these embodiments, state machine 300 dwells on state 320 for some time so that, due to the compressions being according to mode M2, the blood will preferentially accumulate in the lungs where it can become more thoroughly oxygenated, and then state machine 300 can return to state 310 for some time so that, due to the compressions being according to mode M1, the blood will preferentially be pumped into systemic arterial circulatory system 397. This approach may improve CPR blood flow and/or its life-sustaining effects above what either type of compression would provide by itself. The left atrium, which is fairly distensible/compliant, can also potentially serve as a reservoir to accumulate blood during times when the mode favors pumping blood out of the right side of the heart. And then when switching to the mode favoring ejection of blood out of the left heart into the systemic circulation, the left side of the heart is primed full of blood to be pushed out to the systemic circulation.

The invention addresses the fact that, for CPR to successfully sustain a patient in arrest and ultimately lead to return of the patient to neuro-intact life, we believe that CPR must provide at least some minimal amount of blood flow to the brain and also to the heart itself (via the coronary arteries). The properties of the vasculatures in those two organs differ, and there is no particular reason to think that the same CPR pattern would lead to optimal flow to both organs. Therefore, embodiments alternate between modes, which may result in each organ receiving a burst of good blood flow periodically.

As mentioned above, modes M1, M2, . . . can be different in that one or more of the chest compressions performed during these modes can have a chest compression time parameter of a different value. Or more than one chest compression time parameter could change.

In embodiments, a driver of a CPR machine is configured to drive the compression mechanism so as to cause the compression mechanism to perform to the patient's chest a first series of successive compressions characterized by a compression time parameter having a first value, then a second series of successive compressions characterized by the compression time parameter having a second value at least 10% larger than the first value, and then a third series of successive compressions characterized by the compression time parameter having a third value at least 10% smaller than the second value. These can be according to the modes described above.

Figure 4:
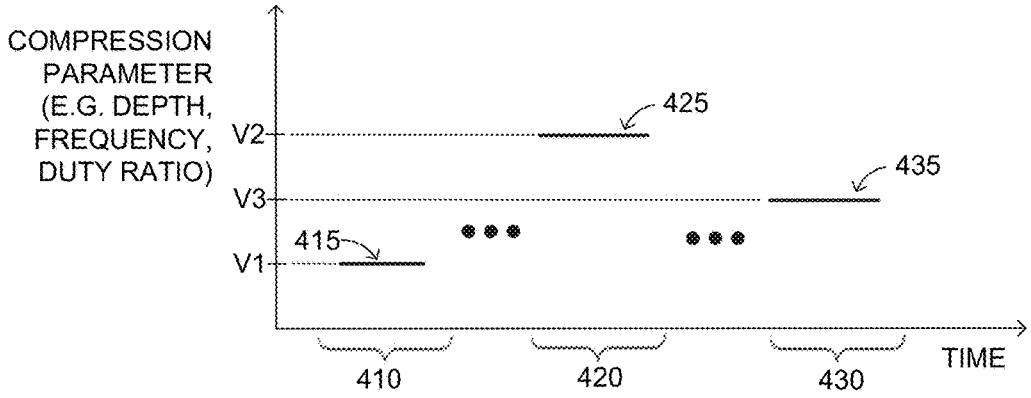
FIG. 4 is a time diagram illustrating that a time parameter value of series of successive chest compressions can change according to embodiments.

FIG. 4 is a time diagram of selected chest compressions during a single resuscitation event for a patient. The shown compressions are at different modes at time ranges 410, 420, 430. The modes are different because the value of at least one time parameter of these chest compressions changes, as shown by waveform segments 415, 425, 435. In the example of FIG. 4, during time range 410 a first series of successive compressions is being performed that is characterized by the compression time parameter having a first value V1. Then, during time range 420 a second series of successive compressions is being performed that is characterized by the compression time parameter having a second value V2. Value V2 can be larger than value V1, e.g. by 10%, 20% or more. Then, during time range 430 a third series of successive compressions is being performed that is characterized by the compression time parameter having a third value V3. Value V3 can be smaller than value V2, e.g. by 10%, 20% or more.

In the example of FIG. 4 the value changes between the first, second and third series of successive chest compressions. The value can change abruptly or gradually. There can be a pause between the different series or not.

In the example of FIG. 4 there are at least three modes, as characterized by the different parameter values. Where there are only two modes, third value V3 can instead be substantially equal to first value V1, and so on.

In the example of FIG. 4 one can observe the time evolution of the value of a single compression time parameter. In embodiments, more than one of the possible time parameters may change. Some individual examples are now described about the frequency or rate and the duty ratio.

Figure 5:
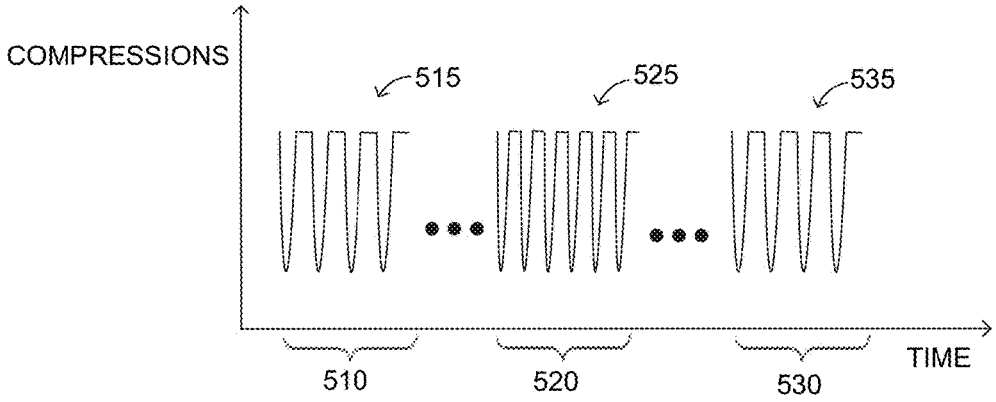
FIG. 5 is a time diagram illustrating an example of three series of successive chest compressions according to embodiments, where the changing time parameter value of FIG. 4 is a frequency of the chest compressions.

FIG. 5 is a time diagram of selected chest compressions during a single resuscitation event according to embodiments. The shown compressions are an example of a first, a second and a third series 515, 525, 535 of certain successive chest compressions selected out of a longer series of chest compressions during the resuscitation event. First, second and third series 515, 525, 535 take place at time ranges 510, 520, 530 respectively. Time ranges 510, 520, 530 could be time ranges 410, 420, 430 of FIG. 4.

It will be appreciated that the shown certain compressions of first series 515, second series 525 and third series 535 are performed substantially periodically, i.e. each has its own frequency or rate. The frequency during time ranges 510 and 530 is F1. The frequency during time range 520 is F2, where F2 is larger than F1 by at least 10%. In other words, in the embodiment of FIG. 5 the compression time parameter includes a frequency of the shown compressions, and its value changes with time from F1 to F2 and then back to F1. This also can correspond to a state machine that has only two states and thus only two modes.

Figure 6:
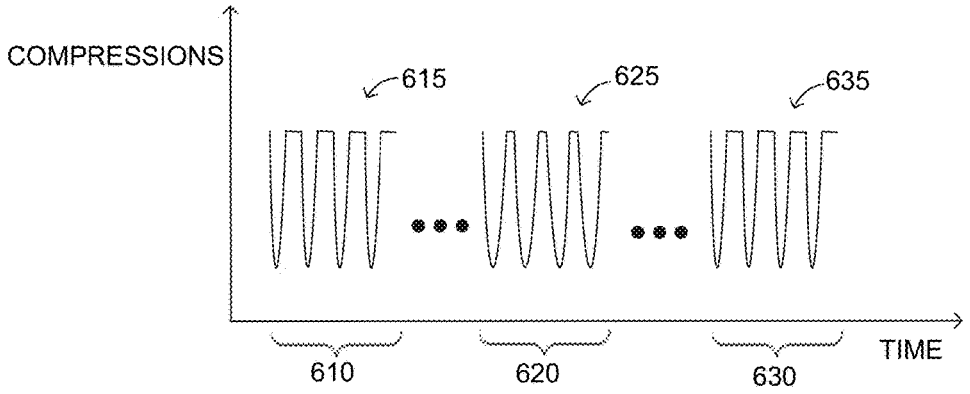
FIG. 6 is a time diagram illustrating an example of three series of successive chest compressions according to embodiments, where the changing time parameter value of FIG. 4 is a duty ratio of the chest compressions.

In one embodiment, the compression rate could alternate between a standard rate (for example 100 compressions per minute) and a higher rate (say 125 compressions per minute). After a run of standard rate compressions, the rate would be increased for a period of time, for example for 10 seconds, and then returned to standard rate for a period of time, for example 10 seconds. In another embodiment, the rate could alternate between periods of a low rate (for example, 80 compressions per minute) and a high rate (for example 120 compressions per minute. Experiments would be needed to figure out the optimal timing and rates. These rates could be better informed, for example, according to a time pattern of R-wave timing seen in a healthy individual, in other words, for embodiments to mimic the variation of heart rate observed in healthy individuals. More particularly, the chest compression rate could be informed by what is known about the heart rate variability (HRV) of a healthy person. More specifically, it is known that the heart rate of a healthy individual varies from moment to moment, and in fact that lack of this variability is one indicator of an unhealthy state. As the autonomic system becomes less effective, the heart rate variability decreases. One way to vary compressions during administration of CPR would be for embodiments to mimic the variation of heart rate observed in healthy individuals. That is, the chest compression device (or CPR coaching metronome) could be programmed to deliver compressions whose rate varies over time FIG. 6 is a time diagram of selected chest compressions during a single resuscitation event according to embodiments. The shown compressions are an example of a first, a second and a third series 615, 625, 635 of certain successive chest compressions selected out of a longer series of chest compressions during the resuscitation event. First, second and third series 615, 625, 635 take place at time ranges 610, 620, 630 respectively. Time ranges 610, 620, 630 could be time ranges 410, 420, 430 of FIG. 4.

As can be seen, the shown certain compressions of first series 615, second series 625 and third series 635 include first periods during which the chest is compressed alternating with second periods during which the chest is not compressed. This is now illustrated by magnification.

Figure 7:
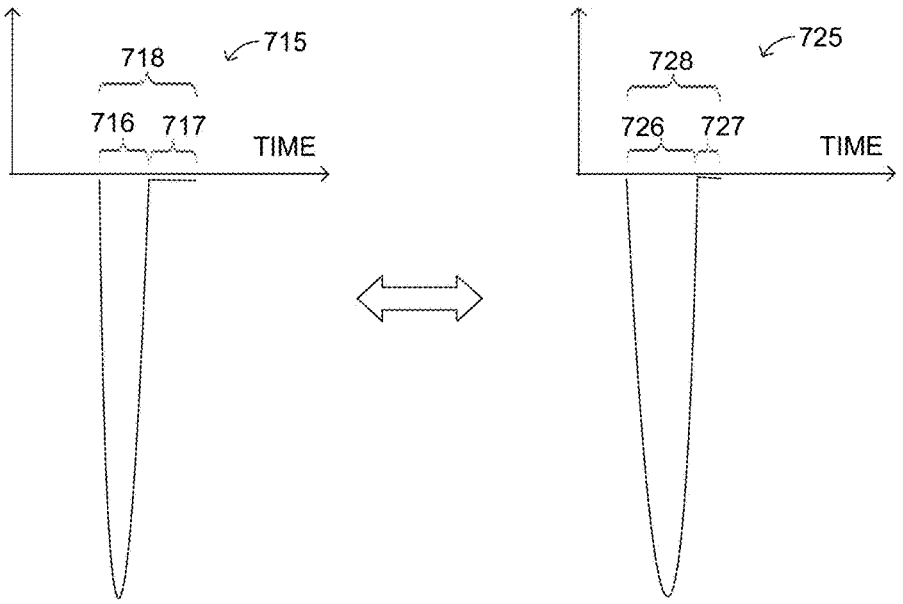
FIG. 7 shows two amplified time diagrams of compressions of FIG. 6 for contrasting their different duty ratios.

FIG. 7 shows two time diagrams 715, 725. Time diagrams 715, 725 show segments of the repeating portions of sessions 615, 625 respectively. The segment of time diagram 715 includes a first period 716 during which the chest is compressed alternating with a second period 717 during which the chest is not compressed. The duty ratio is the ratio of the duration of first period 716 over the duration of second period 717. These two latter durations being approximately equal, the duty ratio for the segment of time diagram 715 is about 1:1=1. The segment of time diagram 725 includes a first period 726 during which the chest is compressed alternating with a second period 727 during which the chest is not compressed. The duty ratio is the ratio of the duration of first period 726 over the duration of second period 727, which is approximately equal to 2.5:1=2.5.

There are alternate ways of defining the duty ratio, but the result is the same. For example, the duty ratio can be defined as the ratio of the duration of the first period over the sum of the durations of the first period and the first period. For diagrams 715, 725, these sums are respectively durations 718, 728. As such, in these alternate definitions the duty ratio will be always less than one, and thus can be expressed as a percentage, and can also be called duty cycle. For example, in scholarly publications on CPR, the duty cycle is the percentage of the cycle during which the compression mechanism is down, squeezing the chest.

Returning to FIG. 6, then, it will be appreciated that the shown certain compressions in each of first series 615, second series 625 and third series 635 have their own duty ratios. The duty ratios during time ranges 610 and 630 are 1. The duty ratios during time range, 620 are 2.5. In other words, in the embodiment of FIG. 6 the compression time parameter of the shown compressions includes a duty ratio of a duration of one or more of the first periods over a duration of one or more the second periods, and its value changes with time from 1 to 2.5 and then back to 1. This also corresponds to a state machine that has only two states and thus only two modes.

The devices and/or systems made according to embodiments perform functions, processes and/or methods, as described in this document. These functions, processes and/or methods may be implemented by one or more devices that include logic circuitry, such as was described for controller 110.

Moreover, methods and algorithms are described below. This detailed description also includes flowcharts, display images, algorithms, and symbolic representations of program operations within at least one computer readable medium. An economy is achieved in that a single set of flowcharts is used to describe both programs, and also methods. So, while flowcharts describe methods in terms of boxes, they also concurrently describe programs.

Methods are now described.

Figure 8:
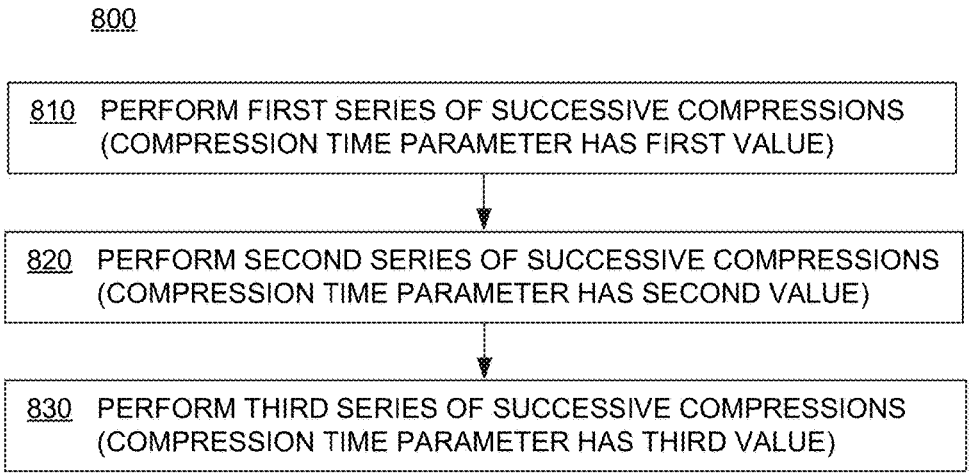
FIG. 8 is a flowchart illustrating methods according to embodiments.

FIG. 8 shows a flowchart 800 for describing methods according to embodiments. The methods of flowchart 800 may also be practiced by embodiments described elsewhere in this document.

According to an operation 810, a first series of successive compressions is performed. This first series can be characterized by a compression time parameter having a first value.

According to another operation 820, a second series of successive compressions is performed. This second series can be characterized by the compression time parameter having a second value. The second value can be larger than the first value by 10%, 20% or more.

According to another operation 830, a third series of successive compressions is performed. The third series can be characterized by the compression time parameter having a third value. The third value can be smaller than the second value by 10%, 20% or more.

In some embodiments a prolonged compression is interposed between other compressions, such as series of regular successive compressions. For example, a driver of a CPR machine can be configured to drive the compression mechanism so as to cause the compression mechanism to perform to the patient's chest a first series of successive compressions at a frequency of at least 70 bpm, and then a prolonged compression during which the compression mechanism compresses the chest for at least 1 sec. Examples are now described.

Figure 9:
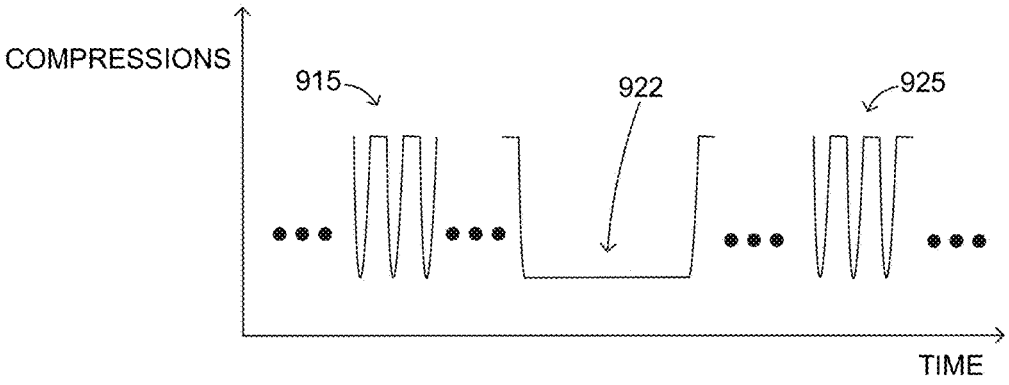
FIG. 9 is a time diagram illustrating an example of how a prolonged compression can be generally interposed between other compressions according to embodiments.

FIG. 9 is a time diagram of selected chest compressions during a single resuscitation event according to embodiments. The shown compressions are an example of a first and a second series 915, 925 of certain successive chest compressions selected out of a longer series of chest compressions during the resuscitation event. First and second series 915, 925 can be thought of as "regular", in that they are at a frequency of at least 70 beats per minute ("bpm"), and often faster, such as 100 bpm and even 120 bpm, as recently recommended by the American Heart Association.

As can be seen, a single prolonged compression 922 is interposed between series 915, 925 according to embodiments. Compression 922 is prolonged in that it lasts for 1, 2, 3 full seconds or even longer, a duration which is substantially longer—at least percentage wise—than the duration of a typical compression performed at 70 bpm or faster. Indeed, an individual compression performed at even the slow rate of 70 bpm, with a high duty cycle of 50% corresponds to a time period of no more than 0.43 sec, followed by a similar release time, as can be seen for example in FIG. 7. However, prolonged compression 922 lasts definitely longer, and may give the blood the opportunity to reach more of its hoped-for destinations that are farther from the compression point, thus improving clinical outcome.

While shown in FIG. 9 as an example, it is not required that both series 915, 925 take place in all embodiments. The compressions of FIG. 9 may include compressions beyond series 915 or 925, such as single compressions, additional prolonged compressions, one or more pauses, and so on.

Figure 10:
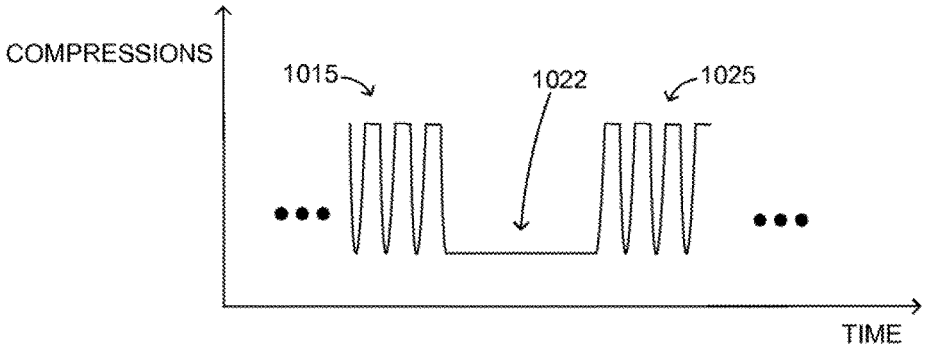
FIG. 10 is a time diagram illustrating a sample embodiment of the pattern of FIG. 9.

FIG. 10 is a time diagram of selected chest compressions during a single resuscitation event according to embodiments. The shown compressions are an example of a first and a second series 1015, 1025 of certain successive chest compressions selected out of a longer series of chest compressions during the resuscitation event. First and second series 1015, 1025 can be thought of as "regular", in that they are at a frequency of at least 70 beats per minute ("bpm"), and often faster, such as 100 bpm and even 120 bpm. A prolonged compression 1022 is interposed between series 1015, 1025 according to embodiments. Compression 1022 is prolonged in that it lasts for 2 sec, 3 sec, or even longer. Of course, while the compressions of series 1015 are shown as similar to those of series 1025, they could be different, and so on.

Figure 11:
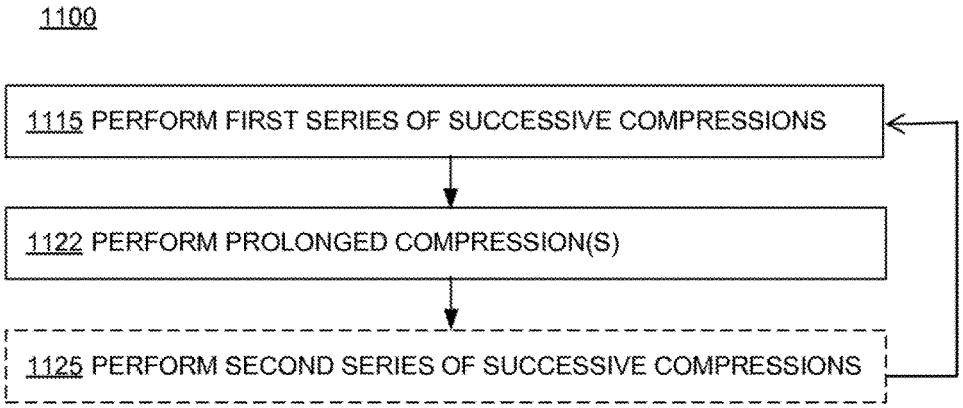
FIG. 11 is a flowchart illustrating methods according to embodiments.

FIG. 11 shows a flowchart 1100 for describing methods according to embodiments. The methods of flowchart 1100 may also be practiced by embodiments described elsewhere in this document.

According to an operation 1115, a first series of successive compressions is performed at a frequency of at least 70 bpm.

According to another operation 1122, a prolonged compression is performed, during which the compression mechanism compresses the chest for at least 2 sec.

According to another, optional operation 1125, a second series of successive compressions is performed at a frequency of at least 70 bpm. Of course, this pattern can be accompanied with other patterns, for example execution could then return to operation 1115.

Returning to FIG. 1, components 100 can be augmented with a sensor (not shown) for sensing a physiological parameter of patient 182. The physiological parameter can be an Arterial Systolic Blood Pressure (ABSP), a blood oxygen saturation (SpO2), a ventilation measured as End-Tidal CO2 (ETCO2), a temperature, a detected pulse, etc. In addition, this parameter can be what is detected by defibrillator electrodes that may be attached to patient 182, such as ECG and impedance. The sensor can be implemented either on the same device as controller 110 or not, and so on.

Upon sensing the physiological parameter, a value of it can be transmitted to controller 110, as is suggested via arrow 119. Transmission can be wired or wireless.

Controller 110 may further optionally aggregate resuscitation data, for transmission to a post processing module 190. The resuscitation data can include what is learned via arrow 119, time data, etc. Transmission can be performed in many ways, as will be known to a person skilled in the art. In addition, controller 110 can transmit status data of the CPR chest compression machine that includes retention structure 140.

Additionally, embodiments may be able to adapt, according to the sensed physiological parameter, the time parameter of the compressions or the duration of the prolonged compressions.

Figure 12:
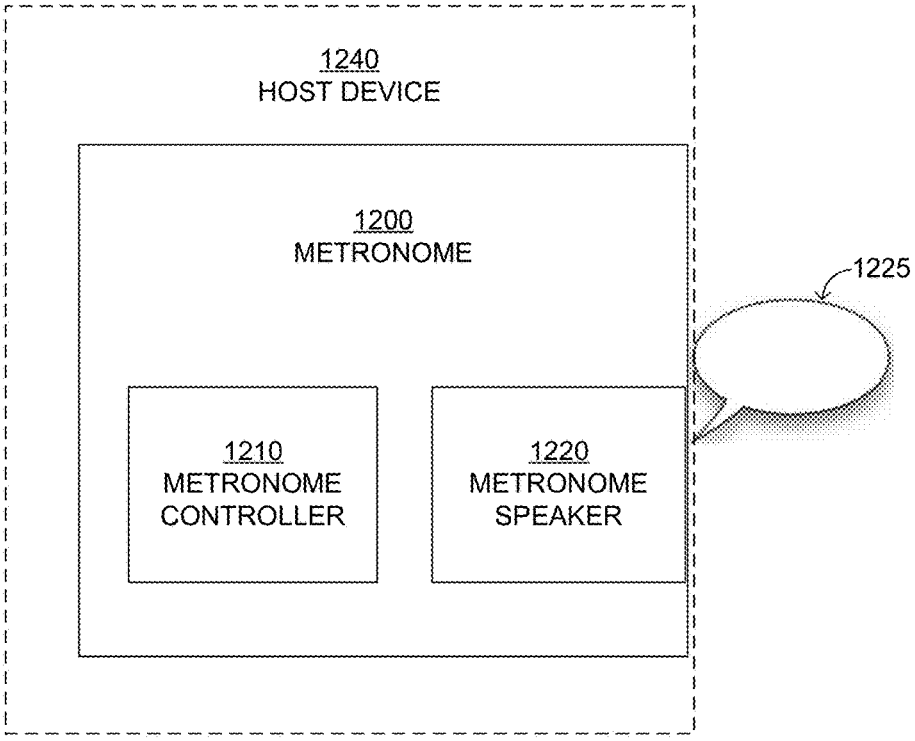
FIG. 12 is a diagram of a sample CPR metronome made according to embodiments.

FIG. 12 is a diagram of a sample CPR metronome 1200 made according to embodiments. In embodiments, CPR metronome 1200 is configured to guide a rescuer to perform Cardio-Pulmonary Resuscitation ("CPR") chest compressions on a patient. CPR metronome 1200 is stand-alone, or may be provided in a host device 1240 such as a defibrillator, a medical monitor, a CPR feedback device, a smartphone, and so on.

CPR metronome 1200 includes a metronome controller 1210. Metronome controller 1210 can be configured to generate prompt signals, which can be predetermined, if metronome controller 1210 is not programmable.

CPR metronome 1200 additionally includes a speaker 1220. Speaker 1220 is configured to issue audible prompts 1225 responsive to the prompt signals generated by metronome controller 1210. Prompts 1225 are intended to guide the rescuer to perform the chest compressions to the patient's chest. The chest compressions can be as described above. Implementing prompts 1225 as musical cues may be helpful in enabling the rescuer to follow rhythm, other than a constant pattern of compressions.

In the methods described above, each operation can be performed as an affirmative step of doing, or causing to happen, what is written that can take place. Such doing or causing to happen can be by the whole system or device, or just one or more components of it. In addition, the order of operations is not constrained to what is shown, and different orders may be possible according to different embodiments. Moreover, in certain embodiments, new operations may be added, or individual operations may be modified or deleted. The added operations can be, for example, from what is mentioned while primarily describing a different system, apparatus, device or method.

A person skilled in the art will be able to practice the present invention in view of this description, which is to be taken as a whole. Details have been included to provide a thorough understanding. In other instances, well-known aspects have not been described, in order to not obscure unnecessarily the present invention. Plus, any reference to any prior art in this description is not, and should not be taken as, an acknowledgement or any form of suggestion that this prior art forms parts of the common general knowledge in any country.

This description includes one or more examples, but that does not limit how the invention may be practiced. Indeed, examples or embodiments of the invention may be practiced according to what is described, or yet differently, and also in conjunction with other present or future technologies. Other embodiments include combinations and sub-combinations of features described herein, including for example, embodiments that are equivalent to: providing or applying a feature in a different order than in a described embodiment; extracting an individual feature from one embodiment and inserting such feature into another embodiment; removing one or more features from an embodiment; or both removing a feature from an embodiment and adding a feature extracted from another embodiment, while providing the features incorporated in such combinations and sub-combinations.

In this document, the phrases "constructed to" and/or "configured to" denote one or more actual states of construction and/or configuration that is fundamentally tied to physical characteristics of the element or feature preceding these phrases. This element or feature can be implemented in any number of ways, as will be apparent to a person skilled in the art after reviewing the present disclosure, beyond any examples shown in this example.

The following claims define certain combinations and subcombinations of elements, features and steps or operations, which are regarded as novel and non-obvious. Additional claims for other such combinations and subcombinations may be presented in this or a related document. When used in the claims, the phrases "constructed to" and/or "configured to" reach well beyond merely describing an intended use, since such claims actively recite an actual state of construction and/or configuration based upon described and claimed structure.

What is claimed is:

1. A machine for performing Cardio-Pulmonary Resuscitation ("CPR") chest compressions on a patient, the machine comprising:

a retention structure configured to retain the patient;

a compression mechanism configured to perform successive CPR compressions to a chest of the retained patient; and a controller configured to control a driver configured to drive the compression mechanism so as to cause the compression mechanism to perform to the patient's chest a first series of successive CPR compressions, the first series including at least two compressions at a frequency of at least 70 beats per minute ("bpm"), wherein each of the at least two compressions has an equal compression duration, a first prolonged CPR compression immediately subsequent to the at least two compressions, during which the compression mechanism compresses the chest for a duration of at least 1 second, and a second series of successive CPR compressions immediately subsequent to the first prolonged compression, the second series of successive CPR compressions including at least two compressions at a frequency of at least 70 bpm.

2. The machine of claim 1, in which during the first prolonged CPR compression the compression mechanism compresses the chest for a duration of at least 3 seconds.

3. The machine of claim 1, in which the driver is further configured to then drive the compression mechanism so as to cause the compression mechanism to perform to the patient's chest a second prolonged CPR compression during which the compression mechanism compresses the chest for a duration of at least 2 seconds.

4. A method for a Cardio-Pulmonary Resuscitation ("CPR") compression machine having a retention structure configured to retain a patient, a compression mechanism configured to perform successive CPR compressions to a chest of the retained patient, the method comprising:

performing a first series of successive CPR compressions, the first series including at least two compressions at a frequency of at least 70 beats per minute ("bpm"), wherein each of the at least two compressions has an equal compression duration; and performing a first prolonged CPR compression immediately subsequent to the at least two compressions, during which the compression mechanism compresses the chest for a duration of at least 1 second; and performing a second series of successive CPR compressions immediately subsequent to the first prolonged compression, the second series of successive CPR compressions including at least two compressions at a frequency of at least 70 bpm.

5. The method of claim 4, in which during the first prolonged CPR compression the compression mechanism compresses the chest for a duration of at least 3 seconds.

6. The method of claim 4, further comprising:

performing a second prolonged CPR compression during which the compression mechanism compresses the chest for a duration of at least 2 seconds.

7. A non-transitory storage medium having stored thereon instructions which, when executed by a Cardio-Pulmonary Resuscitation ("CPR") compression machine having a retention structure configured to retain a patient, a compression mechanism configured to perform successive compressions to a chest of the retained patient and a driver configured to drive the compression mechanism, result in:

performing a first series of successive CPR compressions, the first series including at least two compressions at a frequency of at least 70 beats per minute ("bpm"), wherein each of the at least two compressions has an equal compression duration;

performing a first prolonged CPR compression immediately subsequent to the at least two compressions, during which the compression mechanism compresses the chest for a duration of at least 1 second; and performing a second series of successive CPR compressions immediately subsequent to the first prolonged compression, the second series of successive CPR compressions including at least two compressions at a frequency of at least 70 bpm.

8. The medium of claim 7, in which during the first prolonged CPR compression the compression mechanism compresses the chest for a duration of at least 3 seconds.

9. The medium of claim 7, in which when the instructions are executed they further result in:

performing a second prolonged CPR compression during which the compression mechanism compresses the chest for a duration of at least 2 seconds.

* * * * *